US010581190B1

(12) United States Patent
Phillips et al.

(10) Patent No.: US 10,581,190 B1
(45) Date of Patent: Mar. 3, 2020

(54) CONTACT FOR AN ELECTRICAL CONNECTOR

(71) Applicants: TE CONNECTIVITY CORPORATION, Berwyn, PA (US); Tyco Electronics (Shanghai) Co., Ltd., Shanghai (CN)

(72) Inventors: Michael John Phillips, Camp Hill, PA (US); Randall Robert Henry, Lebanon, PA (US); Timothy Robert Minnick, Enola, PA (US); Justin Dennis Pickel, Hummelstown, PA (US); Liang Huang, Chengdu (CN)

(73) Assignees: TE CONNECTIVITY CORPORATION, Berwyn, PA (US); TYCO ELECTRONICS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/120,788

(22) Filed: Sep. 4, 2018

(30) Foreign Application Priority Data

Aug. 30, 2018 (CN) ..... 2018 1 0998908

(51) Int. Cl.

| | |
|---|---|
| ***H01R 12/73*** | (2011.01) |
| ***H01R 13/115*** | (2006.01) |
| ***H01R 13/6474*** | (2011.01) |
| *H01R 12/72* | (2011.01) |
| *H01R 13/24* | (2006.01) |

(52) U.S. Cl.
CPC ..... *H01R 13/115* (2013.01); *H01R 12/737* (2013.01); *H01R 13/6474* (2013.01); *H01R 12/721* (2013.01); *H01R 13/2442* (2013.01)

(58) Field of Classification Search
CPC ..... H01R 13/2442; H01R 12/721
See application file for complete search history.

(56) References Cited

U.S. PATENT DOCUMENTS

| | | | | | |
|---|---|---|---|---|---|
| 3,131,017 | A * | 4/1964 | Mittler | H01R 12/721 | 439/857 |
| 3,474,380 | A * | 10/1969 | Miller | H01R 12/721 | 439/520 |
| 3,555,497 | A * | 1/1971 | Watanabe | H01R 13/112 | 439/857 |
| 3,697,926 | A * | 10/1972 | Krafthefer | H01R 12/716 | 439/629 |
| 3,993,381 | A * | 11/1976 | Horbach | H05K 7/1038 | 439/525 |

(Continued)

FOREIGN PATENT DOCUMENTS

| | | |
|---|---|---|
| CN | 204144494 U | 2/2015 |
| WO | 2018039351 A1 | 3/2018 |

*Primary Examiner* — Tho D Ta

(57) ABSTRACT

A contact includes a main body having a top, a bottom, a first side and a second side. The contact includes a terminating end extending from the main body and a mating beam extending from the main body opposite the terminating end. The mating beam has a root at the main body and a tip opposite the root. The mating beam has an elongated coupling base between the root and the tip. The elongated coupling base has a bottom surface configured to face a mating contact being generally parallel to the mating contact between the root and the tip.

21 Claims, 4 Drawing Sheets

(56) References Cited

U.S. PATENT DOCUMENTS

| | | | | |
|---|---|---|---|---|
| 5,127,849 | A * | 7/1992 | Karl | H01M 2/1055 429/181 |
| 5,462,443 | A * | 10/1995 | Kurbjuhn | H01R 12/57 439/78 |
| 5,545,045 | A * | 8/1996 | Wakamatsu | H05K 7/1023 439/525 |
| 6,116,970 | A * | 9/2000 | Yamamoto | H01R 13/113 439/852 |
| 6,200,174 | B1 * | 3/2001 | Katoh | H01R 4/4818 439/843 |
| 6,227,917 | B1 * | 5/2001 | Chou | H01R 43/16 439/862 |
| 6,957,964 | B2 * | 10/2005 | Chiang | H01R 13/2435 439/66 |
| 7,410,392 | B2 | 8/2008 | Szczesny et al. | |
| 8,052,428 | B2 * | 11/2011 | Tsao | H01R 13/24 439/66 |
| 8,231,441 | B2 | 7/2012 | Westmann et al. | |
| 9,300,103 | B2 | 3/2016 | Buck et al. | |
| 9,831,588 | B2 | 11/2017 | Cohen | |
| 2008/0057800 | A1 * | 3/2008 | Zhang | H01R 13/2442 439/878 |
| 2018/0006406 | A1 | 1/2018 | Craton | |
| 2019/0003694 | A1 * | 1/2019 | Eckert | F21V 23/006 |

* cited by examiner

CONTACT FOR AN ELECTRICAL CONNECTOR

CROSS-REFERENCE TO RELATED APPLICATIONS

This application claims priority to Chinese Patent Application No. 201810998908.4 which was filed Aug. 30, 2018 and is titled CONTACT FOR AN ELECTRICAL CONNECTOR. The subject matter of which is herein incorporated by reference in its entirety

BACKGROUND OF THE INVENTION

The subject matter herein relates generally to contacts for electrical connectors.

Electrical connectors include contacts for mating with mating contacts, such as of a mating electrical connector or mating circuit board. Conventional contacts include mating portions having spring beams that are spring biased against the mating contacts when mated thereto. The mating portions of conventional contacts utilize two bends or curved sections that create a controlled single point of contact with the mating contact. The first bend creates an offset from the beam, such as to drop the point of contact downward out of the plane of the contact and the second bend creates the controlled contact surface by bending the tip of the contact back upward. The second bend creates a lead-in tip to guide mating with the mating electrical component or mating circuit board, such as to reduce the risk of mechanical stubbing during mating. The bends shape the contact to maintain a relatively constant beam length and controlled force at the area of contact.

However, conventional contacts are not without disadvantages. The swooping shape defined by the bends at the area of contact is problematic at high speed data transmission. For example, the contact loses effectiveness in high speed data transmission at higher frequencies due to, for example, mismatched impedance from the electrical stub created in the gap or space between the contact and the mating contact. For example, the mating contact has a predetermined length designed for sufficient contact wipe during mating and the excess length of the mating contact under the beam of the contact is an area of mismatched impedance leading to decreased electrical performance.

A need remains for a contact for an electrical connector having improvised electrical performance for high speed data transmission.

BRIEF DESCRIPTION OF THE INVENTION

In one embodiment, a contact is provided including a main body having a top, a bottom, a first side and a second side. The contact includes a terminating end extending from the main body and a mating beam extending from the main body opposite the terminating end. The mating beam has a root at the main body and a tip opposite the root. The mating beam has an elongated coupling base between the root and the tip. The elongated coupling base has a bottom surface configured to face a mating contact being generally parallel to the mating contact between the root and the tip.

In another embodiment, a contact is provided including a main body having a top, a bottom, a first side and a second side. The contact includes a terminating end extending from the main body and a mating beam extending from the main body opposite the terminating end. The mating beam has a root at the main body and a tip opposite the root. The mating beam has an elongated coupling base between the root and the tip. The root is sloped downward at a root angle defined between the main body and the coupling base and the tip is sloped upward at a tip angle defined between the coupling base and a distal end of the mating beam. The coupling beam is angled at a coupling beam angle shallower than the root angle and the tip angle. The elongated coupling base has a bottom surface configured to face a mating contact being generally parallel to the mating contact between the root and the tip.

In a further embodiment, an electrical connector is provided including a housing having a mating end for mating with a plug connector having mating contacts and a contact array held in the housing. The contact array has contacts at the mating end positioned for mating with the mating contacts. Each contact includes a main body having a top, a bottom, a first side and a second side. The contact includes a terminating end extending from the main body and a mating beam extending from the main body opposite the terminating end. The mating beam has a root at the main body and a tip opposite the root. The mating beam has an elongated coupling base between the root and the tip. The elongated coupling base has a bottom surface configured to face a mating contact being generally parallel to the mating contact between the root and the tip.

In another embodiment, a contact is provided including a main body having a top, a bottom, a first side and a second side, a terminating end extending from the main body, and a mating beam extending from the main body opposite the terminating end. The mating beam has a root at the main body and a tip opposite the root. The mating beam has an elongated coupling base between the root and the tip. The root is sloped downward at a root angle defined between the main body and the coupling base and the tip being sloped upward at a tip angle defined between the coupling base and a distal end of the mating beam. The coupling beam is angled at a coupling beam angle shallower than the root angle and the tip angle.

DETAILED DESCRIPTION OF THE INVENTION

Figure 1:
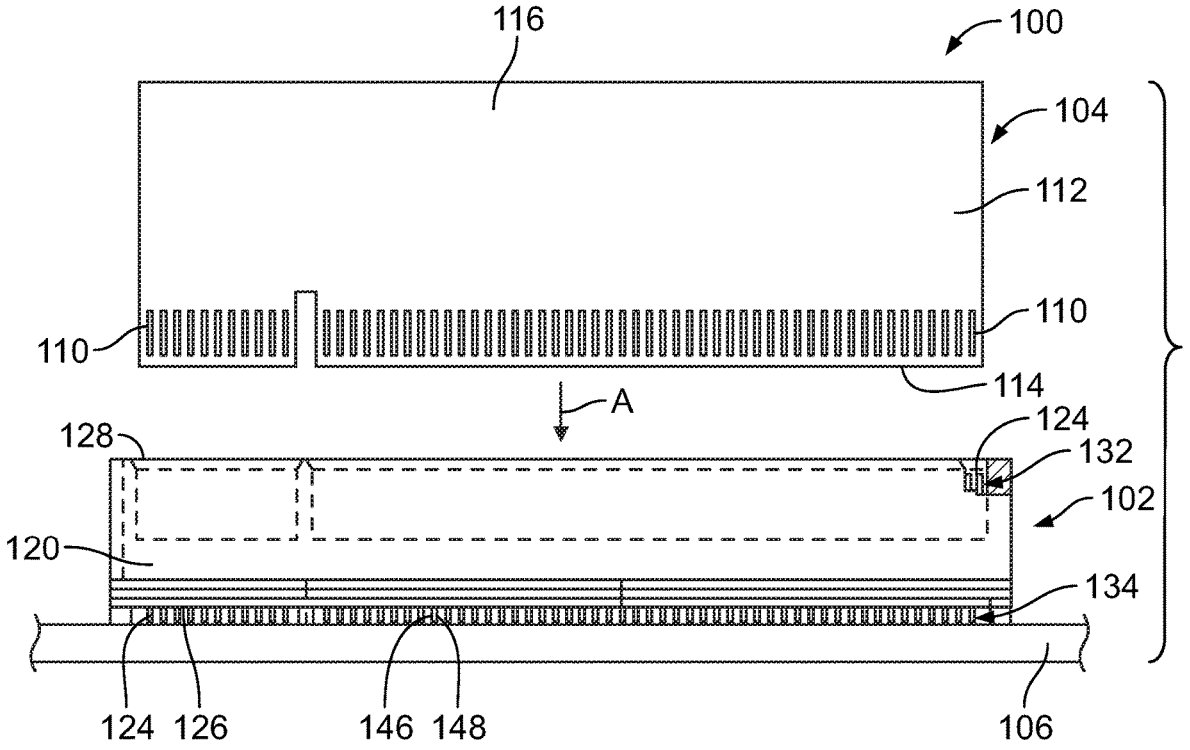
FIG. 1 is a front view of an electrical system having an electrical connector in accordance with an exemplary embodiment.
Figure 2:
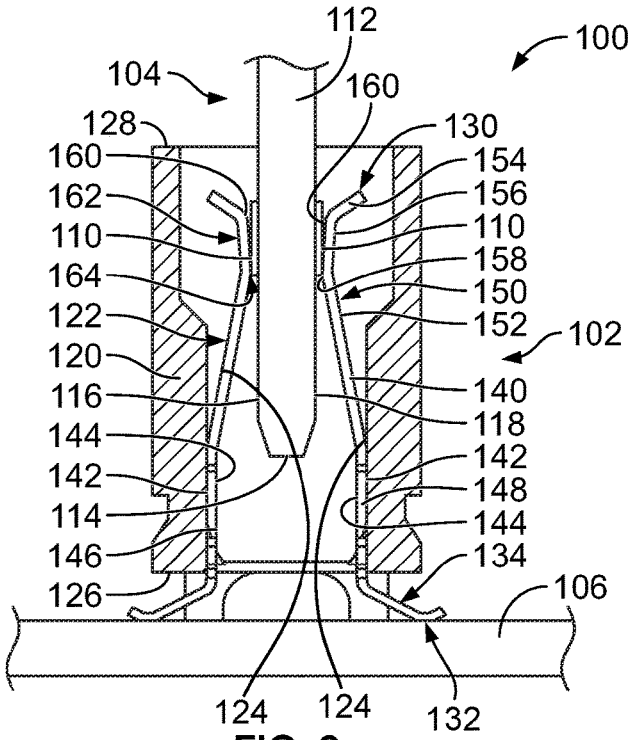
FIG. 2 is a side, cross-sectional view of the electrical connector in accordance with an exemplary embodiment.

FIG. 1 is a front view of an electrical system 100 having an electrical connector 102 in accordance with an exemplary embodiment. FIG. 2 is a side, cross-sectional view of the electrical connector 102 in accordance with an exemplary embodiment. The electrical connector 102 is configured to be mated with a mating electrical connector 104. FIG. 2 illustrates the mating electrical connector 104 mated with the electrical connector 102. In an exemplary embodiment, the electrical connector 102 is a receptacle connector and may be referred to hereinafter as receptacle connector 102. For example, the electrical connector 102 may be a card edge connector; however, the electrical connector 102 may be other types of connectors in alternative embodiments. In an exemplary embodiment, the mating electrical connector 104 is a plug connector and may be referred to hereinafter as a plug connector 104. For example, the mating electrical connector 104 may be a pluggable module. In various embodiments, the mating electrical connector 104 is a mating circuit board, such as a circuit card.

In the illustrated embodiment, the electrical connector 102 is mounted to a host circuit board 106; however, the electrical connector 102 may be a cable connector in alternative embodiments terminated to one or more cables rather than the circuit board 106. The electrical connector 102 may be a vertical card edge connector assembly where the components are oriented and mated generally vertically or perpendicular to the host circuit board 106. However, in other various embodiments, the electrical system 100 may have components in different orientations, such as at a right angle orientation.

The mating electrical connector 104 includes mating contacts 110 configured to be mated with the electrical connector 102. In an exemplary embodiment, the mating electrical connector 104 includes a circuit board 112 having circuits defining the mating contacts 110. For example, the mating contacts 110 may be contact pads provided proximate to an edge 114 of the circuit board 112. The circuits may transmit data and/or power between the mating contacts and other electrical components (for example, memory, processors, and the like on the circuit board 112). The edge 114 of the circuit board 112 is configured to be received in the electrical connector 102. The circuit board 112 and the mating contacts 110 may define a paddle card configured to be mated with the electrical connector 102. The mating contacts 110 may be provided on one or both sides 116, 118 of the circuit board 112.

In various embodiments, the mating electrical connector 104 may include a housing holding the mating contacts 110 and/or the circuit board 112. The housing may be a separate component receiving the mating contacts 110 and/or the circuit board 112. In other various embodiments, the housing may be formed on the circuit board 112, such as by overmolding around the circuit board 112 and/or the mating contacts 110. The housing may include guide features to guide mating with the electrical connector 102 and/or latching features for securing the mating electrical connector 104 to the electrical connector 102. In various embodiments, the circuits of the circuit board 112 may be electrically connected to one or more cables extending from the mating electrical connector 104. In alternative embodiments, the mating electrical connector 104 may be provided without the circuit board 112, having the mating contacts 110 as individual contacts, such as blade contacts held within a housing. The individual contacts may be terminated to wires or cables extending from the mating electrical connector 104. In other various embodiments, the individual contacts may be terminated to a circuit board or other electrical component.

The electrical connector 102 includes a housing 120 holding an array 122 of contacts 124. Optionally, the contacts 124 may be arranged in two rows within the housing 120 for mating with both sides 116, 118 of the circuit board 112 of the mating electrical connector 104. The housing 120 has a base 126 configured to be mounted to the host circuit board 106, by using fasteners such as solder clips or other mounting elements. The contacts 124 are terminated to the host circuit board 106, such as by soldering the contacts 124 to the host circuit board 106. The housing 102 has a mating end 128 configured to receive the mating electrical connector 104, for example, the circuit board 112. The mating end 128 is provided at a top of the housing 120 to receive the circuit board 112 in a generally vertical mating direction, such as a mating direction perpendicular to the host circuit board 106 represented by arrow A.

Each contact 124 extends between a mating end 130 and a terminating end 132. The mating end 130 is configured to be mated with the corresponding mating contact 110. The terminating end 132 is configured to be coupled to the circuit board 106. For example, in an exemplary embodiment, the terminating end 132 includes a tail 134 configured to be terminated to the circuit board 106. The tail 134 may be a solder tail in various embodiments configured to be soldered to the surface of the circuit board 106. The tail 134 may be a compliant pin, such as a press-fit pin, in alternative embodiments for termination to the circuit board 106. For example, the press-fit pin may be received in a plated via of the circuit board 106. In other various embodiments, the terminating end 132 may be terminated to another component, such as a wire in alternative embodiments. For example, the terminating end 132 may include a crimp barrel or other feature for termination to the wire.

The contact 124 includes a main body 140 between the mating end 130 and the terminating end 132. The contact has a top 142, a bottom 144, a first side 146 and a second side 148. The bottom 144 is configured to face the mating electrical connector 104 and the top 142 is opposite the bottom 144. The first and second sides 146, 148 are edges, such as stamped or cut edges formed during a stamping process of the contact 124. The terminating end 132 extends from the main body 140. For example, the tail 134 may be formed integral with and extend from the main body 140. For example, the tail 134 may be stamped and formed with the main body 140.

The mating end 130 includes a mating beam 150 extending from the main body 140 opposite the terminating end 132. The mating beam 150 includes a root 152 at the main body 140 and a tip 154 opposite the root 152. The mating beam 150 has an elongated coupling base 156 between the root 152 and the tip 154. The elongated coupling base 156 includes a bottom surface 158 along the bottom 144 facing the mating contact 110. In an exemplary embodiment, the elongated coupling base 156 is generally parallel to the mating contact 110 between the root 152 and the tip 154. The elongated coupling base 156 provides efficient electrical coupling between the mating beam 150 of the contact 124 and the mating contact 110.

In an exemplary embodiment, the elongated coupling base 156 includes at least one point of contact 160 with the mating contact 110. The elongated coupling base 156 includes a capacitive coupling segment 162 adjacent point of contact 160 separated from the mating contact 110 by a capacitive gap 164. The capacitive coupling segment 162 is effectively capacitively coupled to the mating contact 110 across the capacitive gap 164. Having the elongated coupling base 156 close to parallel with the mating contact 110 closely couples the capacitive coupling segment 162 with the mating contact 110 in the vicinity of the point of contact 160 to enhance electrical performance of the contact 124 compared to conventional contacts (for example, FIG. 9) having a curved section immediately adjacent the point of contact.

Figure 9:
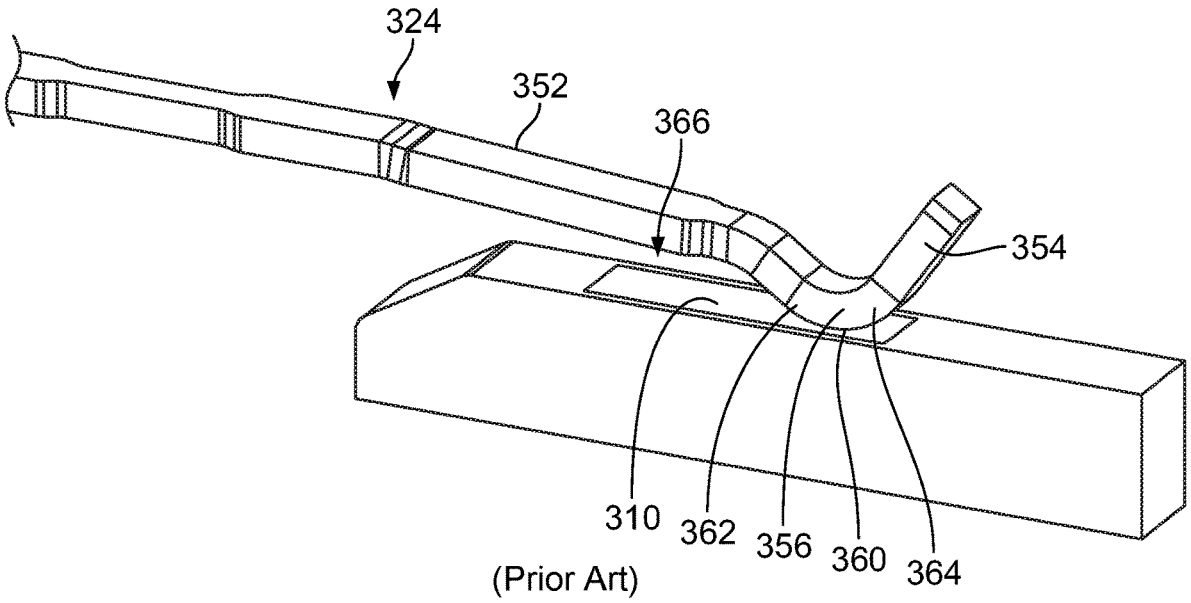
(Prior Art) FIG. 9
FIG. 9 illustrates a conventional contact.

FIG. 9 illustrates a conventional contact 324 having a base 356 between a root 352 and a tip 354. The base 356 has a point of contact 360 with a mating contact 310. The base 356 includes a first curve 362 upstream of the point of contact 360 and a second curve 364 downstream of the point of contact 360. The first curve 362 transitions the contact 324 between the base 356 and the root 352 and elevates the structure of the conventional contact 324 above the mating contact 310 by a gap 366. The second curve 364 transitions the contact 324 between the base 356 and the tip 354. The structure of the contact 324 is quickly elevated away from the mating contact 310 by the first curve 362 and by the second curve 364. For example, the root 352 and the tip 354 are spaced apart from the mating contact 110 with the base 356 being curved along the transition between the root 352 and the tip 354. The curved shape of the base 356 defines the point of contact 360, but quickly moves the structure of the contact 324 away from the mating contact 310 leading to very little capacitive coupling between the contact 324 and the mating contact 310, such as across the wide gap 366. The extreme curved shape of the conventional contact 324 (FIG. 9) around the point of contact 360 lifts the upstream and downstream sections of the contact 324 away from the mating contact 310 and separates such sections from the mating contact 310 by gaps having mismatched impedance due to electrical stubs created along the gaps between the curved section and the mating contact 310. Such mismatched impedance leads to signal degradation, particularly for high speed data transmission.

Returning to FIGS. 1 and 2, the contact 124 is shaped differently than the conventional contact 324. The coupling base 156 is elongated and kept close to and generally parallel to the mating contact 110. Such shape and proximity the coupling base 156 to the mating contact 110 counters the negative effects suffered by the conventional contact 324 (FIG. 9) by locating the elongated coupling base 156 close to and generally parallel with the mating contact 110 as opposed to separating such segment from the mating contact. The capacitive coupling induced along the capacitive coupling segment 162 reduces impedance mismatch, common in the conventional contact 324, which enhances electrical performance along the signal paths defined by the contacts 124.

Figure 3:
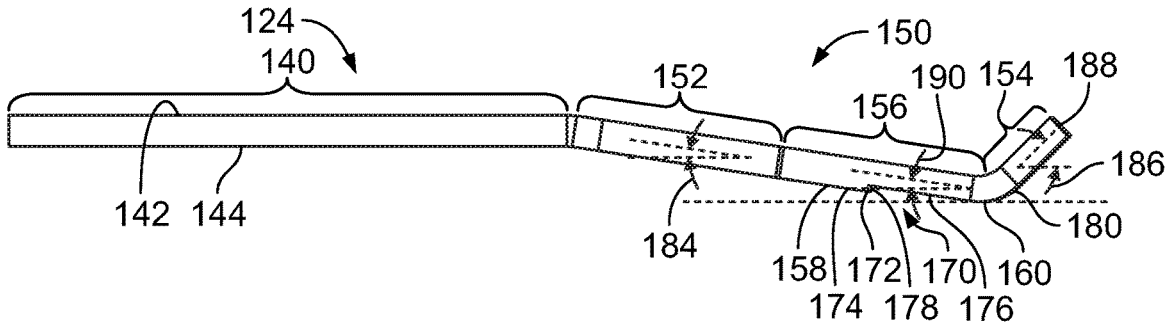
FIG. 3 is a side view of a contact of the electrical connector in accordance with an exemplary embodiment.
Figure 4:
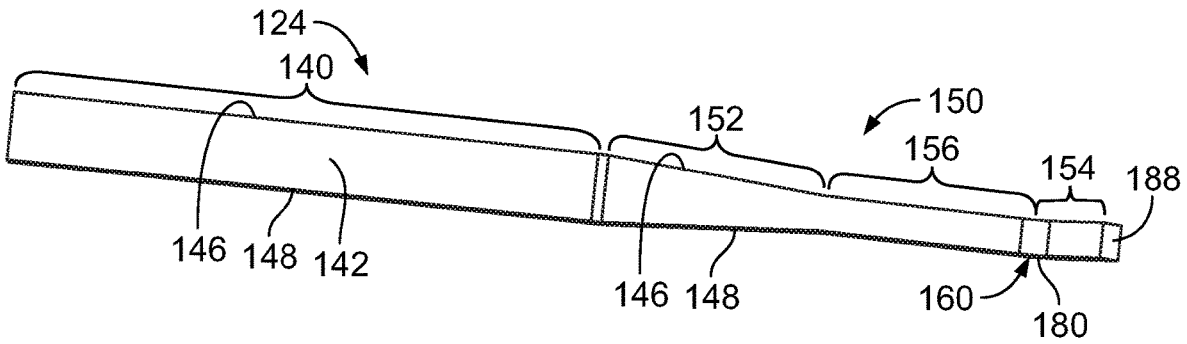
FIG. 4 is a top view of the contact in accordance with an exemplary embodiment.

FIG. 3 is a side view of the contact 124 in accordance with an exemplary embodiment. FIG. 4 is a top view of the contact 124 in accordance with an exemplary embodiment. FIGS. 3 and 4 illustrate the mating beam 150 extending from the main body 140. The root 152 extends from the main body 140. The coupling base 156 extends from the root 152. The tip 154 extends from the coupling base 156.

In an exemplary embodiment, the mating beam 150 is narrower than the main body 140 reducing the mechanical strength of the mating beam 150 compared to the main body 140. For example, the mating beam 150 is more flexible than the main body 140 because the mating beam 150 is narrower than the main body 140. In an exemplary embodiment, the mating beam 150 is narrower than the main body 140 between the first and second sides 146, 148. For example, the root 152 may be tapered inward along the first side 146 and/or the second side 148. In various embodiments, the root 152 is tapered such that the width of the coupling base 156 is approximately half the width of the main body 140. In an exemplary embodiment, the mating beam 150 is narrower than the main body 140 between the top 142 and the bottom 144. For example, the coupling base 156 may be narrower (for example, thinner) then the main body 140. The coupling base 156 may be cut, ground, shaved, planed, skived, coined, stretched, or otherwise processed to thin the material of the coupling base 156 compared to the main body 140. In other alternative embodiments, the coupling base 156 may be manufactured to be thinner, such as by a casting or molding process. In various embodiments, the coupling base 156 is approximately 10% thinner than the main body 140. In other various embodiments, the coupling base 156 may be approximately 25% or more thinner than the main body 140. Optionally, the tip 154 may be thinner like the coupling base 156 compared to the main body 140. Alternatively, the tip 154 may be thicker like the main body compared to the coupling base 156.

In an exemplary embodiment, the bottom surface 158 of the mating beam 150 is stamped at one or more location(s), such as along the coupling base 156, to make the mating beam 150 thinner. For example, in the illustrated embodiment, the bottom surface 158 includes a first step 170 having a corner 172. The corner is configured to face the mating contact 110. The first step 170 is defined by a first section 174 and a second section 176 upstream and downstream of the corner 172. The first step 170 includes a shoulder 178 between the first section 174 and the second section 176. The mating beam 150 is thinner along the second section 176 and thicker along the first section 174. Optionally, the corner 172 may be generally coplanar with the end of the coupling base 156, such as at a bend 180 where the tip 154 extends from the coupling base 156. The bend 180 defines the point of contact 160. Having the corner 172 generally coplanar with the bend 180 (the point of contact 160) allows both the corner 172 and the bend 180 to engage the mating contact 110. For example, the corner 172 may define a second point of contact. The first section 174 and the second section 176 are close to being within the plane of the points of contact such that the first section 174 and the second section 172 may be close to the mating contact 110 and capacitively coupled to the mating contact 110 for high, efficient coupling between the contact 124 and mating contacts 110.

The mating beam 150 has a generally convex shape along the bottom surface 158 with the apex of the mating beam 150 forming the point of contact 160 with the mating contact 110. The root 152 is sloped downward at a root angle 184 (compared to a plane parallel to the mating contact 110) of the root 152 defined generally between the main body 140 and the coupling base 156. The root angle 184 may be less than 45°, such as less than 20° in various embodiments. The tip 154 is sloped upward at a tip angle 186 (compared to a plane parallel to the mating contact 110) of the tip 154 defined generally between the coupling base 156 and a distal end 188 of the mating beam 150. The tip angle 186 may be approximately 45°; however, the tip angle 186 may be greater than or less than 45° in other various embodiments. The coupling base 156 is angled at a coupling beam angle 190 (compared to a plane parallel to the mating contact 110) of the coupling base 156 defined generally between the root 152 and the tip 154. The coupling beam angle 190 may be less than 45°, such as less than 25° in various embodiments. Optionally, the coupling beam angle 190 may be less than 10° in various embodiments. In an exemplary embodiment, the coupling beam angle 190 is shallower (for example, closer to parallel to the mating contact 110) than the tip angle 192. In an exemplary embodiment, the coupling beam angle 190 is shallower than the root angle 184 (for example, closer to parallel to the mating contact 110). Optionally, the root angle 184 may be shallower that the tip angle 186 (for example, closer to parallel to the mating contact 110). Other angles are possible in alternative embodiments, such as with the root angle 184 approximately equal to the tip angle 186.

Figure 5:
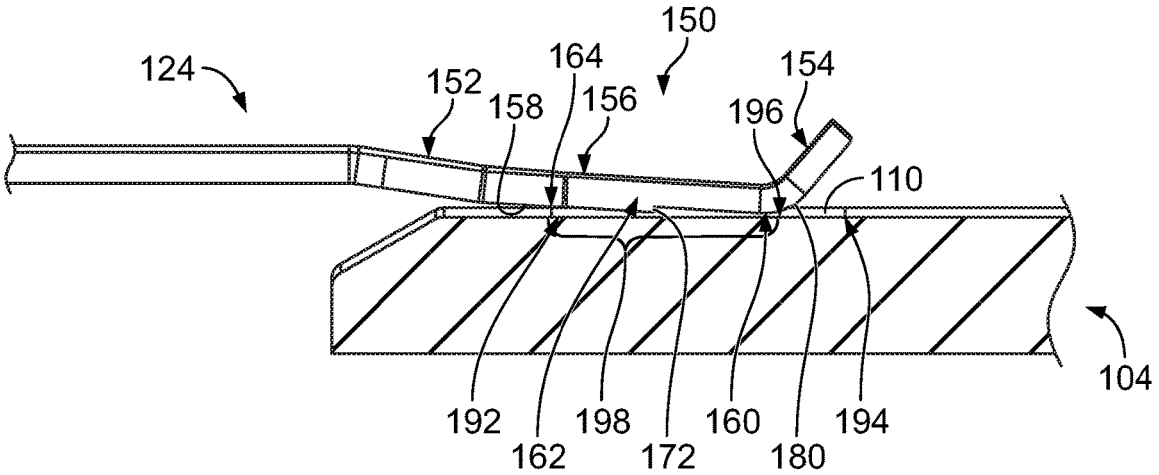
FIG. 5 is a side view of the contact showing the contact mated with a mating contact of a mating electrical connector.

FIG. 5 is a side view of the contact 124 showing the contact 124 mated with the mating contact 110 of the mating electrical connector 104. When the contact 124 is mated with the mating contact 110, the bottom surface 158 of the contact 124 is pressed inward against the mating contact 110. For example, the contact 124 may be flexed outward, causing the contact 124 to be spring biased inward against the mating contact 110. The shape of the contact 124 along the mating beam 150 may be flattened out when the contact 124 is pressed against the mating contact 110 causing the elongated coupling base 156 to be flattened or pressed toward the mating contact 110. In an exemplary embodiment, the elongated coupling base 156 is generally parallel to the mating contact 110 between the root 152 and the tip 154 when mated to the mating contact 110.

In an exemplary embodiment, the elongated coupling base 156 includes the first point of contact 160 with the mating contact 110 at the bend 180 and the second point of contact with the mating contact 110 at the corner 172. In other various embodiments, the corner 172 may be slightly elevated off of the mating contact 110 rather than defining the second point of contact. However, the elongated coupling base 156 extends along the mating contact 110 in close proximity to the mating contact 110. The elongated coupling base 156 defines the capacitive coupling segment 162 between the tip 154 and the root 152. Because the elongated coupling base 156 is generally parallel to the mating contact 110, the capacitive gap 164 is very narrow. For example, the capacitive gap 164 is sufficiently narrow as to allow the capacitive coupling segment 162 to be effectively capacitively coupled to the mating contact 110 for a significant length. In various embodiments, the capacitive gap 164 is narrower than the thickness of the mating contact 110 along a length at least twice the thickness of the mating contact 110. In an exemplary embodiment, the elongated coupling base 156 is generally parallel to the mating contact 110 along a majority of the length of the mating contact 110 between a first end 192 and a second end 194 of the mating contact 110. In an exemplary embodiment, the mating contact 110 includes at least one point of contact 196 with the contact 124 (for example, at the point of contact 160). In an exemplary embodiment, the capacitive coupling segment 162 extends along the mating contact 110 for substantially the entire length of the mating contact 110 between the point of contact 196 and the first end 192. For example, the mating beam 150 is sufficiently close to the mating contact 110 for substantially the entire length of the mating contact 110 between the point of contact 196 and the first end 192 to substantially or entirely eliminate the effects of any electrical stub along such length of the signal path.

In an exemplary embodiment, the mating contact 110 includes a wipe segment 198 defined between the first end 192 and the point of contact 196. The contact 124 wipes along the wipe segment 198 during mating. In an exemplary embodiment, the capacitive coupling segment 162 extends along the mating contact 110 for substantially the entire length of wipe segment 198 of the mating contact 110. For example, the capacitive gap 164 is sufficiently narrow between the contact 124 and the wipe segment 198 to substantially or entirely eliminate the effects of any electrical stub along the wipe segment 198. Having the elongated coupling base 156 close to parallel with the mating contact 110 along the wipe segment 198 closely couples the capacitive coupling segment 162 with the mating contact 110 in the vicinity of the wipe segment 198 to enhance electrical performance of the contact 124 compared to conventional contacts (for example, FIG. 9) having the swooping curved sections immediately adjacent the point of contact. The elongated coupling base 156 counters the negative effects suffered by conventional contacts (FIG. 9) by locating the elongated coupling base 156 close to and generally parallel with the mating contact 110 along the wipe segment 198 as opposed to separating such segment from the mating contact 110. The capacitive coupling induced along the capacitive coupling segment 162 reduces impedance mismatch, common in conventional contacts, enhancing electrical performance along the signal path.

Figure 6:
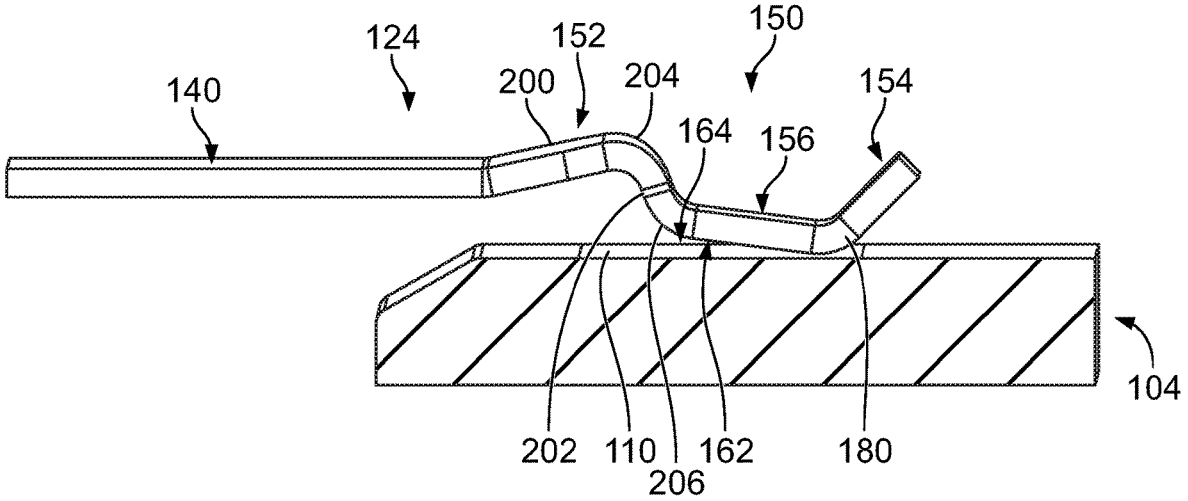
FIG. 6 is a side view of the contact in accordance with an exemplary embodiment showing the contact coupled to the mating contact of the mating electrical connector.
Figure 7:
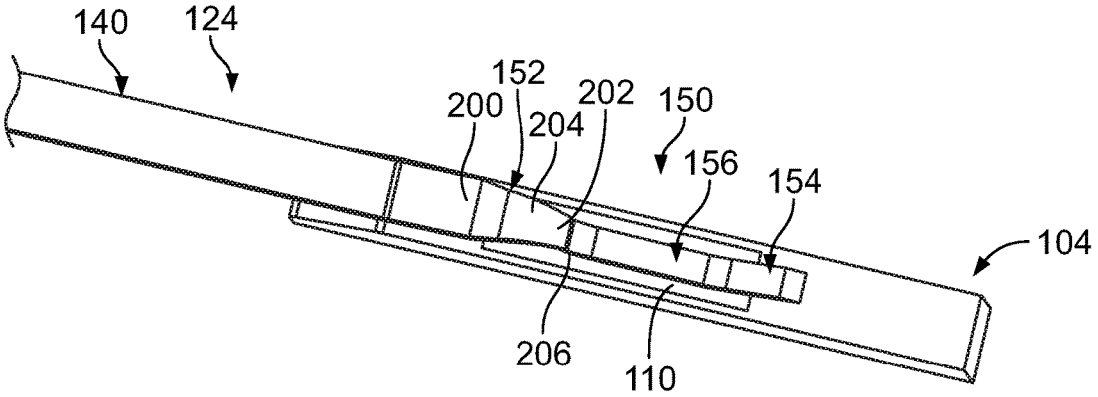
FIG. 7 is a top view of the contact in accordance with an exemplary embodiment showing the contact coupled to the mating contact of the mating electrical connector.

FIG. 6 is a side view of the contact 124 in accordance with an exemplary embodiment showing the contact 124 coupled to the mating contact 110 of the mating electrical connector 104. FIG. 7 is a top view of the contact 124 in accordance with an exemplary embodiment showing the contact 124 coupled to the mating contact 110 of the mating electrical connector 104. The embodiment of the contact 124 illustrated in FIGS. 6 and 7 is similar to the contact 124 illustrated in FIGS. 3 and 4; however, the mating beam 150 of the contact 124 illustrated in FIGS. 6 and 7 is shaped differently than the mating beam 150 of the contact 124 illustrated in FIGS. 3 and 4.

The root 152 extends from the main body 140. The coupling base 156 extends from the root 152. The tip 154 extends from the coupling base 156. In an exemplary embodiment, the root 152 includes a first portion 200 and a second portion 202. The root 152 includes a first pivot point 204 between the first portion 200 and the second portion 202. The root 152 is flexible at the first pivot point 204. The root 152 is curved or bent at the first pivot point 204 such that the second portion 202 is angled nonparallel relative to the first portion 200. In various embodiments, the second portion 202 is angled at greater than 45° relative to the first portion 200. In the illustrated embodiment, the second portion 202 is angled at approximately 90° relative to the first portion 200. The root 152 includes a second pivot point 206 between the second portion 202 and the coupling base 156. The root 152 is flexible at the second pivot point 206. The root 152 is curved or bent at the second pivot point 206 such that the coupling base 156 is angled nonparallel relative to the second portion 202.

The mating beam 150 flexes at the first and second pivot points 204, 206 when the mating beam 150 is coupled to the mating contact 110 to press the coupling base 156 toward the mating contact 110. For example, the root 152 may be stretched out and flexed at the first pivot point 204 and/or the second pivot point 206 to tilt the coupling base 156 closer to parallel to the mating contact 110 during mating. For example, after the bend 180 initially engages the mating contact 110, further downward pressure on the contact 124 toward the mating contact 110 causes the coupling base 156 to pivot closer to the mating contact 110. The coupling base 156 moves closer to parallel to the mating contact 110 by pressing the second pivot point 206 closer to the mating contact 110, which causes the coupling base 156 to move closer to the mating contact 110. The capacitive gap 164 narrows as the contact 124 is pressed closer to the mating contact 110, increasing the capacitive coupling between the capacitive coupling segment 162 and the mating contact 110. In an exemplary embodiment, the coupling base 156 is straight between the second pivot point 206 and the bend 180 such that the entire coupling base 156 may be directly coupled to the mating contact 110 along the entire length of the coupling base 156 when sufficient mating pressure is applied between the contact 124 and the mating contact 110.

Figure 8:
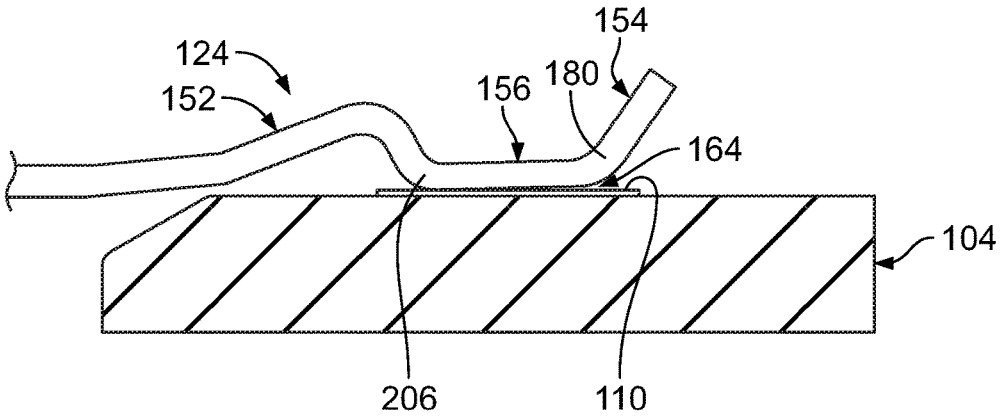
FIG. 8 is a side view of the contact in accordance with an exemplary embodiment showing the contact coupled to the mating contact of the mating electrical connector.

FIG. 8 is a side view of the contact 124 in accordance with an exemplary embodiment showing the contact 124 coupled to the mating contact 110 of the mating electrical connector 104. FIG. 8 illustrates a mating situation in which the second pivot point 206 defines a point of contact with the mating contact 110. Overpressure on the contact 124 causes the bend 180 to lift upward off of the mating contact 110. The capacitive gap 164 is defined between the coupling base 156 and the mating contact 110 between the second pivot point 206 and the bend 180. The coupling base 156 is close to parallel to the mating contact 110 between the root 152 and the tip 154.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact comprising:

a main body having a top, a bottom, a first side and a second side, the main body having a front and a rear;

a terminating end extending from the rear of the main body; and a mating beam extending from the front of the main body opposite the terminating end, the mating beam having a root at the main body and a tip opposite the root at a front end of the mating beam, the mating beam being mated with a mating contact in a forward mating direction from the tip to the root, the mating beam having a coupling base elongated between the root and the tip, the coupling base having a bottom surface configured to face the mating contact, the bottom surface being generally parallel to the mating contact between the root and the tip.

2. The contact of claim 1, wherein the coupling base includes a single point of contact with the mating contact and a capacitive coupling segment adjacent the point of contact separated from the mating contact by a capacitive gap, the capacitive coupling segment being effectively capacitively coupled to the mating contact across the capacitive gap.

3. The contact of claim 2, wherein the capacitive coupling segment is a first capacitive coupling segment and is located toward the root from the point of contact, the mating beam further comprising a second capacitive coupling segment adjacent the point of contact being located toward the tip from the point of contact and being separated from the mating contact by a second capacitive gap, the second capacitive coupling segment being effectively capacitively coupled to the mating contact across the second capacitive gap.

4. The contact of claim 1, wherein the coupling base includes two points of contact with the mating contact, the points of contact being separated by a capacitive gap.

5. The contact of claim 1, wherein the root is sloped downward at a root angle and the tip is sloped upward at a tip angle, the coupling base being angled at a coupling beam angle shallower than the root angle and the tip angle.

6. The contact of claim 1, wherein the bottom surface is stepped and includes at least a first step having a corner, the corner facing the mating contact.

7. The contact of claim 6, the mating beam further comprising a bend between the coupling base and the tip, the bend defining a point of contact, the corner being generally coplanar with the point of contact.

8. The contact of claim 1, wherein the root is tapered such that the coupling base is narrower than the main body between the first side and the second side.

9. The contact of claim 1, wherein the root includes a first portion and a second portion, the root includes a first pivot point between the first portion and the second portion such that the second portion is flexible and angled non-parallel relative to the first portion, the root includes a second pivot point between the second portion and the coupling base such that the coupling base is flexible and angled non-parallel relative to the second portion, the mating beam flexing at the first and second pivot points when the mating beam is coupled to the mating contact to press the coupling base toward the mating contact.

10. The contact of claim 1, wherein the coupling base is generally parallel to the mating contact along a majority of the mating contact.

11. A contact comprising:

a main body having a top, a bottom, a first side and a second side;

a terminating end extending from the main body; and a mating beam extending from the main body opposite the terminating end, the mating beam having a root at the main body and a tip opposite the root at a front end of the mating beam, the mating beam having a coupling base elongated between the root and the tip, the root being sloped downward at a root angle defined between the main body and the coupling base, the tip being sloped upward at a tip angle defined between the coupling base and a distal end of the mating beam, the coupling base being angled at a coupling beam angle shallower than the root angle and the tip angle, the coupling base having a bottom surface configured to face a mating contact, the bottom surface being generally parallel to the mating contact between the root and the tip, the mating beam being mated with the mating contact in a forward mating direction from the tip to the root.

12. The contact of claim 11, wherein the coupling base includes a single point of contact with the mating contact and a capacitive coupling segment adjacent the point of contact separated from the mating contact by a capacitive gap, the capacitive coupling segment being effectively capacitively coupled to the mating contact across the capacitive gap.

13. The contact of claim 12, wherein the capacitive coupling segment is a first capacitive coupling segment and is located toward the root from the point of contact, the mating beam further comprising a second capacitive coupling segment adjacent the point of contact being located toward the tip from the point of contact and being separated from the mating contact by a second capacitive gap, the second capacitive coupling segment being effectively capacitively coupled to the mating contact across the second capacitive gap.

14. The contact of claim 11, wherein the coupling base includes two points of contact with the mating contact, the points of contact being separated by a capacitive gap.

15. The contact of claim 11, wherein the bottom surface is stepped and includes at least a first step having a corner, the corner facing the mating contact.

16. The contact of claim 11, wherein the root is tapered such that the coupling base is narrower than the main body between the first side and the second side.

17. The contact of claim 11, wherein the root includes a first portion and a second portion, the root includes a first pivot point between the first portion and the second portion such that the second portion is flexible and angled non-parallel relative to the first portion, the root includes a second pivot point between the second portion and the coupling base such that the coupling base is flexible and angled non-parallel relative to the second portion, the mating beam flexing at the first and second pivot points when the mating beam is coupled to the mating contact to press the coupling base toward the mating contact.

18. An electrical connector comprising:

a housing having a mating end for mating with a plug connector, the plug connector having mating contacts; and a contact array held in the housing, the contact array having contacts at the mating end positioned for mating with the mating contacts, each contact includes a main body having a top, a bottom, a first side and a second side, each contact includes a terminating end extending from the main body and a mating beam extending from the main body opposite the terminating end, the mating beam having a root at the main body and a tip opposite the root at a front end of the mating beam, the mating beam having a coupling base elongated between the root and the tip, the coupling base having a bottom surface configured to face a mating contact, the bottom surface being generally parallel to the mating contact between the root and the tip, the mating beam being mated with the mating contact in a forward mating direction from the tip to the root.

19. The electrical connector of claim 18, wherein the coupling base includes a single point of contact with the mating contact and a capacitive coupling segment adjacent the point of contact separated from the mating contact by a capacitive gap, the capacitive coupling segment being effectively capacitively coupled to the mating contact across the capacitive gap.

20. The electrical connector of claim 18, wherein the root is sloped downward at a root angle defined between the main body and the coupling base and the tip is sloped upward at a tip angle defined between the coupling base and a distal end of the mating beam, the coupling base being angled at a coupling beam angle shallower than the root angle and the tip angle.

21. A contact comprising:

a main body having a top, a bottom, a first side and a second side;

a terminating end extending from the main body; and a mating beam extending from the main body opposite the terminating end, the mating beam having a root at the main body and a tip opposite the root at a front end of the mating beam, the mating beam having a coupling base elongated between the root and the tip, the root being sloped downward at a root angle defined between the main body and the coupling base and the tip being sloped upward at a tip angle defined between the coupling base and a distal end of the mating beam, the coupling base being angled at a coupling beam angle shallower than the root angle and the tip angle, the mating beam being mated with the mating contact in a forward mating direction from the tip to the root.

* * * * *